US009346272B2

(12) United States Patent
Tatebe et al.

(10) Patent No.: US 9,346,272 B2
(45) Date of Patent: May 24, 2016

(54) LIQUID EJECTING HEAD AND LIQUID EJECTING APPARATUS

(71) Applicant: Seiko Epson Corporation, Tokyo (JP)

(72) Inventors: Chiaki Tatebe, Shiojiri (JP); Toshinori Hiraide, Fujimi (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/817,493

(22) Filed: Aug. 4, 2015

(65) Prior Publication Data

US 2016/0082727 A1 Mar. 24, 2016

(30) Foreign Application Priority Data

Sep. 18, 2014 (JP) ..... 2014-189732

(51) Int. Cl.
*B41J 2/135* (2006.01)
*B41J 2/14* (2006.01)
*B41J 2/175* (2006.01)

(52) U.S. Cl.
CPC ..... *B41J 2/1433* (2013.01); *B41J 2/135* (2013.01); *B41J 2/1752* (2013.01); *B41J 2/1408* (2013.01); *B41J 2202/20* (2013.01)

(58) Field of Classification Search
CPC ..... B41J 2/1408; B41J 2/135; B41J 2/1433; B41J 2/1752; B41J 2202/20
USPC ..... 347/44, 40, 47, 17, 49, 86, 87
See application file for complete search history.

(56) References Cited

U.S. PATENT DOCUMENTS

| | | | | |
|---|---|---|---|---|
| 2005/0116984 | A1* | 6/2005 | Tsuda et al. | 347/20 |
| 2005/0270329 | A1* | 12/2005 | Hoisington et al. | 347/42 |
| 2006/0139405 | A1* | 6/2006 | Nellen | 347/49 |
| 2007/0279455 | A1* | 12/2007 | Karlinski et al. | 347/54 |

FOREIGN PATENT DOCUMENTS

| | | | |
|---|---|---|---|
| JP | 2005-225147 | A | 8/2005 |
| JP | 2008-265191 | A | 11/2008 |
| JP | 2014-004692 | A | 1/2014 |

* cited by examiner

*Primary Examiner* — Henok Legesse
(74) *Attorney, Agent, or Firm* — Harness, Dickey & Pierce, P.L.C.

(57) ABSTRACT

There is provided a recording head unit that includes a recording head main body that drives a piezoelectric element to generate a pressure change in ink filling a pressure generation chamber so as to eject the ink through a nozzle formed in a nozzle plate; a holder to hold the recording head main body; and a fixing plate to which end surfaces, on the nozzle plate side, of the recording head main body and the holder are fixed. In the stated recording head unit, the fixing plate includes a slope section that is arranged in part of a predetermined region of the fixing plate where neither the holder nor the recording head main body is fixed, and that has a free movement portion of which cross section is formed in a mountain-like shape and which is capable of freely moving in a direction intersecting with a surface direction of the fixing plate; the fixing plate further includes a fixing portion with which a base end of the free movement portion is fixed to the holder; and the fixing plate is so configured as to be expanded/contracted in the surface direction of the fixing plate by a force applied in this direction.

12 Claims, 7 Drawing Sheets

LIQUID EJECTING HEAD AND LIQUID EJECTING APPARATUS

BACKGROUND

1. Technical Field

The present invention relates to liquid ejecting heads and liquid ejecting apparatuses, and is particularly useful when applied to a laminated structure in which a plurality of components having different coefficients of thermal expansion are attached to one another with attachment surfaces interposed therebetween.

2. Related Art

As a liquid ejecting apparatus, an ink jet recording apparatus (hereinafter, also called "recording apparatus") that performs printing by ejecting ink (liquid) from an ink jet recording head (hereinafter, also called "recording head") in accordance with recording data while feeding a recording medium in a paper feed direction is widely known. The recording head pressurizes ink filling a pressure generation chamber by the displacement of a piezoelectric element so as to eject the ink to the exterior through nozzles formed in a nozzle plate.

Among the recording heads according to the past technique as described above, there exits such a recording head that has a plurality of ink jet recording head main bodies held in a holder made of resin, each of the ink jet recording head main bodies being a unit configured to eject ink through a nozzle. In the above-mentioned recording head, the ink jet recording head main bodies and the holder are attached and fixed to a fixing plate with respective end surfaces on a nozzle plate side of the ink jet recording head main bodies and the holder interposed therebetween. Here, the fixing plate is formed of a SUS plate.

As such, a separation can occur in an attachment portion with the fixing plate in some case due to heat generated in a drive unit including a piezoelectric element resulting from driving of the recording head. To be more specific, heat generated in the head main body is transferred to the holder. The holder is significantly deformed by the heat because the holder, which is made of resin, has a large volume and its coefficient of thermal expansion is greater than that of the fixing plate made of SUS. Because of such significant deformation of the holder, a large stress is generated in the attachment portion with the fixing plate. This stress is transmitted from the fixing plate to the head main body through the attachment portion of the fixing plate and the head main body. As a result, there is a case where a separation occurs in the attachment portion of the holder and the fixing plate, the attachment portion of the head main body and the fixing plate, or the like. In addition, the stress that acts upon the head main body via the attachment portion causes deformation of the nozzle plate in some case. In the case where the nozzle plate is deformed, quality of printing carried out using ink that is ejected through the nozzle will be degraded.

The above problem occurs not only in ink ejecting recording apparatuses configured to eject ink, but also occurs likewise in liquid ejecting apparatuses configured to eject liquids other than ink.

Techniques disclosed in JP-A-2014-4692, JPA-2005-225147, and JP-A-2008-265191, respectively, are known as the existing techniques aimed at the prevention of deformation caused by thermal expansion in the recording head configured as described above. In JP-A-2014-4692, a member having a groove to absorb thermal expansion of an actuator substrate is provided between the actuator substrate and a nozzle plate. However, a hollow bellows structure is not disclosed therein. In JP-A-2005-225147, at a bonding interface where different substrates are bonded, a groove is provided in one of the substrates so as to follow a warp caused by thermal expansion, whereby bonding-layer separation is prevented. However, deformation caused by thermal expansion is not absorbed. In JP-A-2008-265191, a bellows portion that absorbs thermal expansion and is capable of free movement is provided between a head and a head support member. However, deformation caused by thermal loads generated in constituent members that are fixed to both ends of the bellows portion is not absorbed.

SUMMARY

An advantage of some aspects of the invention is to provide a liquid ejecting head and a liquid ejecting apparatus capable of removing influence of stress that acts upon an attachment portion of a holder and a fixing plate, an attachment portion of a head main body and the fixing plate, or the like so as to prevent the occurrence of deformation of a nozzle plate. The above stress is generated by a thermal load due to expansion/contraction of the holder.

In order to achieve the advantage mentioned above, a liquid ejecting head according to an aspect of the invention includes: a liquid ejecting head main body that drives a drive element to generate a pressure change in a liquid filling a pressure generation chamber so as to eject the liquid through a nozzle formed in a nozzle plate; a holder to hold the liquid ejecting head main body; and a fixing plate to which end surfaces, on the nozzle plate side, of the liquid ejecting head main body and the holder are fixed. In the stated liquid ejecting head, the fixing plate includes: a slope section that is arranged in part of a predetermined region of the fixing plate where neither the holder nor the liquid ejecting head main body is fixed, and that has a free movement portion of which cross section is formed in a mountain-like shape or a curved surface shape and which is capable of freely moving in a direction intersecting with a surface direction of the fixing plate; and a fixing portion with which a base end of the free movement portion is fixed to the holder. Further, the fixing plate is so configured as to be expanded/contracted in the surface direction of the fixing plate by a force applied in this direction.

According to this aspect, a thermal load generated due to expansion/contraction of the holder generates stress that is applied in the surface direction of the fixing plate and acts upon an attachment portion of the holder and the fixing plate as well as an attachment portion of the liquid ejecting head main body and the fixing plate as a shearing force. Meanwhile, according to this aspect, because the fixing plate includes a slope section whose cross section is formed in a mountain-like shape or a curved surface shape in a predetermined region of the fixing plate, the stress applied in the surface direction of the fixing plate is absorbed by expansion/contraction of the slope section in the surface direction of the fixing plate. As described above, because the slope section expands/contracts to absorb the stress along the surface of the fixing plate, thermal deformation of the holder is absorbed. As a result, influence of the stress that acts upon the attachment portion of the holder and fixing plate, the attachment portion of the liquid ejecting head main body and fixing plate, or the like is removed so that the occurrence of deformation of the nozzle plate can be prevented.

Further, expansion/contraction of the fixing plate caused by heat that is transferred from the liquid ejecting head main body side with the slope section interposed therebetween is absorbed by the movement of the slope section in a direction intersecting with the surface of the fixing plate, whereby influence of the stress on the periphery of the nozzle in the nozzle plate can be effectively prevented.

Here, it is preferable that the slope section be recessed from a surface of the fixing plate toward the holder side or projected toward a side opposite to the holder. Further, it is preferable that the slope section be a section where a plurality of surfaces are continuously provided in bellows form with the fixing portion being interposed in the surface direction of the fixing plate. The reason for this is as follows: that is, an amount of extension of the fixing plate can be appropriately adjusted in accordance with the amount of extension of the fixing plate due to its thermal expansion resulting from thermal expansion of the holder. Furthermore, it is preferable for the slope section to be configured such that an opened slit is provided in part of the slope section, an opening portion of a suction member faces to an opening of the slit, and a negative pressure is applied to the opening of the slit so as to suck a hollow space of the suction member. The reason for this is as follows: that is, dirt such as ink lees or the like gathered by cleaning operation or the like can be collected in the suction member by making use of the negative pressure applied to the slit. Here, it is preferable for the slit to be opened to the liquid ejecting head main body side in the slope section arranged to be closest to the liquid ejecting head main body side within the predetermined region of the fixing plate. The reason for this is as follows: that is, the dirt pushed and gathered by a blade or the like from the liquid ejecting head main body side can be favorably collected in the vicinity of the slit. Moreover, it is preferable that the suction member be made of an elastic member and have two above-mentioned opening portions, and that the opening portions be arranged in a rear surface of the slope section while striding over upper and lower portions in a slant direction of the slope section so as to face to the openings of two slits, respectively. The reason for this is as follows: that is, extension of the slope section in a direction from the lower portion toward the upper portion thereof due to thermal expansion can be suppressed.

Another aspect according to the invention is a liquid ejecting apparatus in which the above liquid ejecting head is mounted.

According to this aspect, even if a thermal load is generated resulting from driving of the apparatus, the thermal load is favorably absorbed and influence of the thermal load on a nozzle portion can be removed, thereby making it possible to maintain a high level of quality in printing or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, some embodiments of the invention will be described with reference to the drawings.

Figure 1:
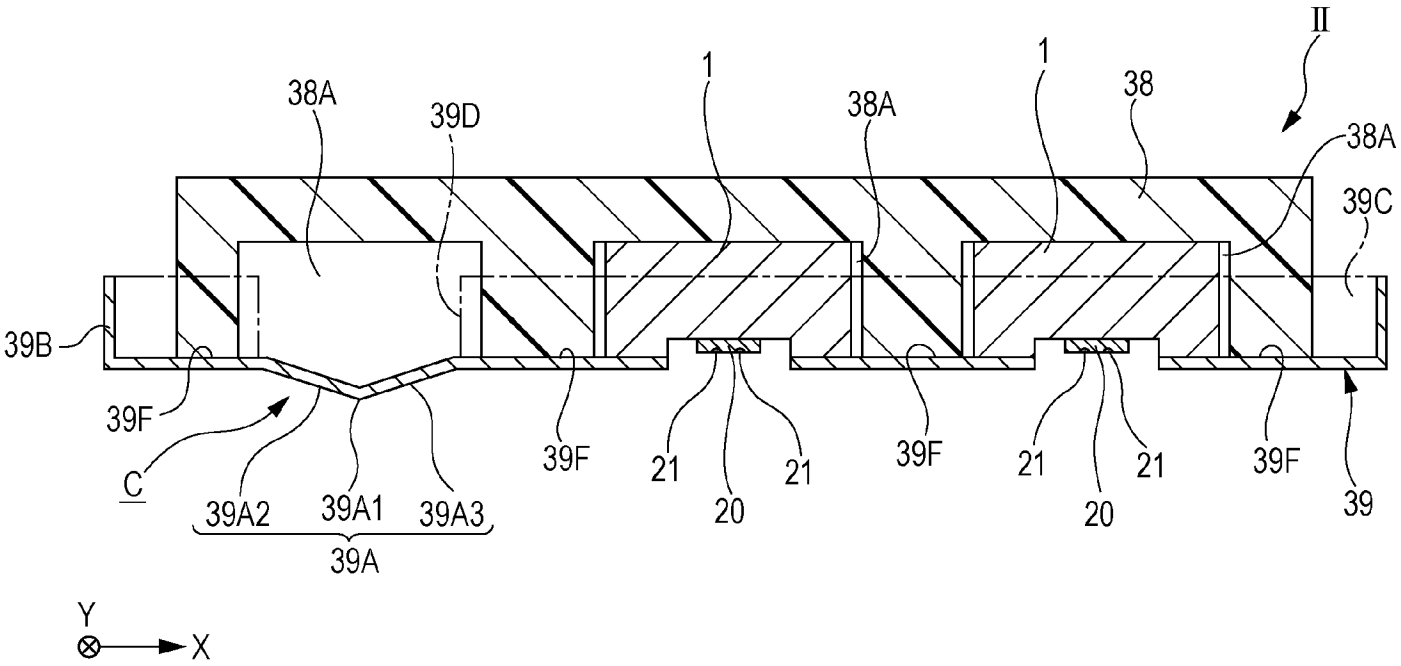
FIG. 1 is a view schematically illustrating a recording head unit according to an embodiment of the invention, and is a cross-sectional view taken along a I-I line in FIG. 2.
Figure 2:
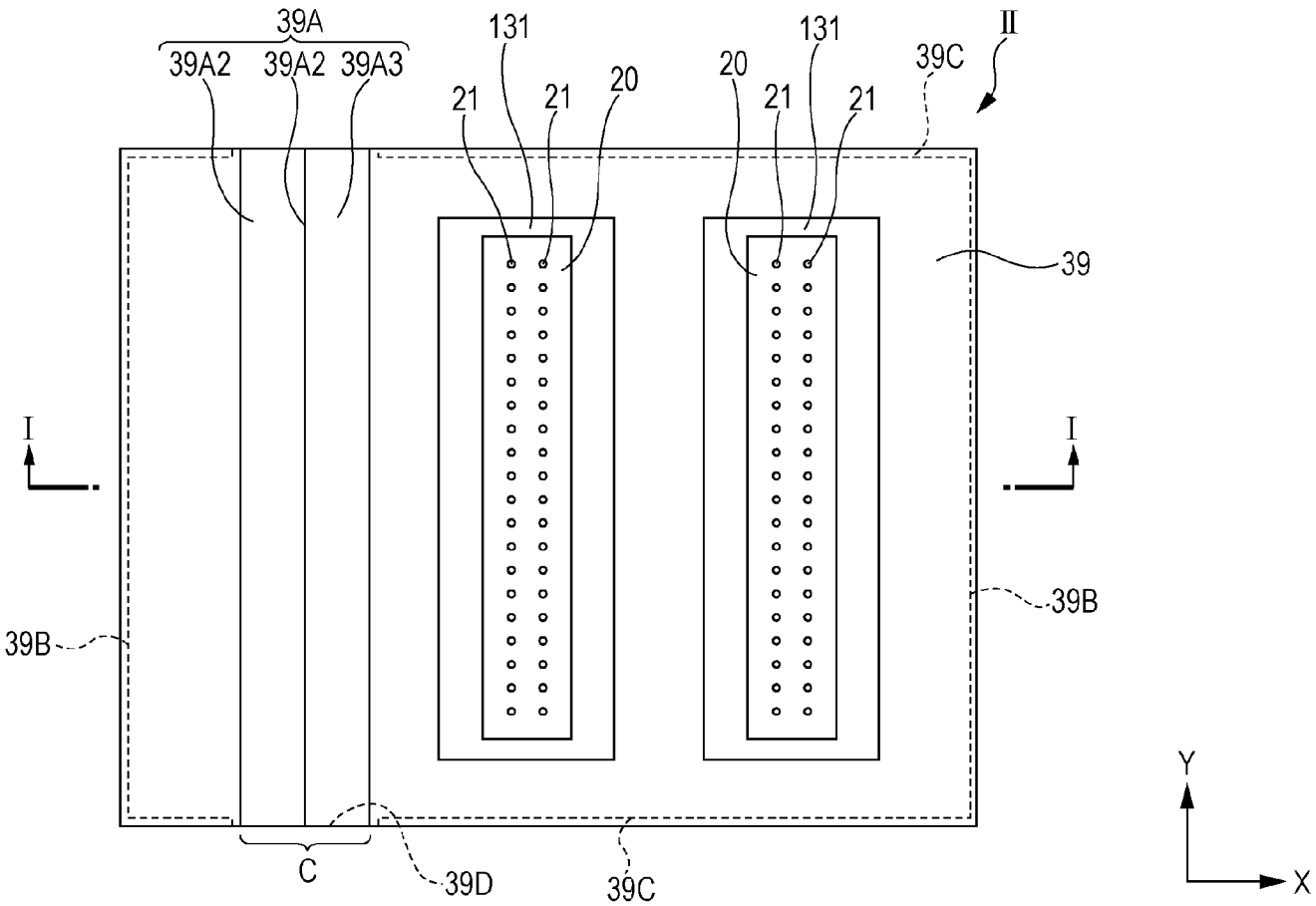
FIG. 2 is a plan view illustrating FIG. 1 when viewed from below (nozzle plate side).

FIG. 1 is a cross-sectional view schematically illustrating an ink jet recording head unit (hereinafter, also called "recording head unit" in a simplified manner) as an example of a liquid ejecting head according to an embodiment of the invention; FIG. 1 is a cross-sectional view taken along a I-I line in FIG. 2, and FIG. 2 is a plan view illustrating FIG. 1 when viewed from below (nozzle plate side). As shown in FIGS. 1 and 2, a recording head unit II includes a plurality of recording head main bodies 1 (two in this example), a holder 38 made of resin that accommodates the recording head main bodies 1 in spaces 38A and covers the entirety of each of the recording head main bodies 1, and a fixing plate 39 made of SUS to which the recording head main bodies 1 and the holder 38 are attached and fixed.

Each of the recording head main bodies 1 ejects ink through nozzles 21 in a normal direction with respect to a surface of a nozzle plate 20. The holder 38 in this embodiment has three spaces 38A having the same shape. The recording head main bodies 1 are accommodated in two of the three spaces 38A, and the rest of the spaces is a vacant space. It is not absolutely necessary to make one of the spaces 38A a vacant space. In this embodiment, a slope section 39A configured of the fixing plate 39 is formed in a predetermined region C of the fixing plate 39 corresponding to the above-mentioned vacant space. In the predetermined region C, neither the holder 38 nor the recording head main body 1 is fixed to the fixing plate 39. In other words, the fixing plate 39 is fixed to the holder 38 as well as the recording head main bodies 1 at an area other than the predetermined region C. The above fixing is carried out using end surfaces on the nozzle plate 20 side of the recording head main bodies 1 and the holder 38.

As described above, the slope section 39A is a free movement portion of which cross section is formed in a mountain-like shape, and which is arranged in part of the predetermined region C of the fixing plate 39 and capable of freely moving in a direction intersecting with a surface direction of the fixing plate 39. Further, the fixing plate 39 includes fixing portions 39F as portions to be fixed to the holder 38 located in the area other than the predetermined region C that is striding over the space 38A. In other words, the fixing plate 39 has the fixing portions 39F with which portions serving as base ends of the free movement portion are fixed to the holder 38.

In this embodiment, the slope section 39A is formed by bending a plane along a bending line 39A1 extending in a second direction Y (a direction orthogonal to a first direction X as a longer side direction of the fixing plate 39) as a shorter side direction of the fixing plate 39 in the predetermined region C of the fixing plate 39. In other words, two planes 39A2 and 39A3 are integrally continued to form a shape of the slope section bent in a mountain-like manner. In this embodiment, the slope section is projected toward a side opposite to the recording head main body 1 (opposite to the space 38A as a vacant space). The slope section may be projected toward the space 38A as a vacant space. However, in the case where the slope section is projected toward a side opposite to the recording head main body 1 like in this embodiment, a configuration of a third working example (see FIGS. 5A through 5C), which will be explained later, can be realized. With this configuration, ink lees gathered by wiping operation (explained later in detail based on FIG. 7) can be collected.

The slope section 39A may be formed in a curved surface shape whose cross section along the first direction X as the longer side direction of the fixing plate 39 is semicircular.

The fixing plate 39, in order to maintain its strength, includes two standing portions 39B and two standing portions 39C that stand upright from the four sides of the rectangle, respectively. Note that in the standing portion 39C along the first direction X as the longer side direction, a part of the standing portion 39C corresponding to the predetermined region C is not present because it is cut out to be a cutout portion 39D. With this configuration, displacement of the slope section 39A along the surface direction of the fixing plate 39 can be made with ease.

According to this embodiment, a thermal load generated due to expansion/contraction of the holder 38 generates stress that is applied in the surface direction of the fixing plate 39 and acts upon an attachment portion of the holder 38 and the fixing plate 39 as well as an attachment portion of the recording head main body 1 and the fixing plate 39 as a shearing force.

Here, since in this embodiment the slope section 39A in the predetermined region C of the fixing plate 39 is included, the dimension of the fixing plate 39 formed at the slope section 39A expands/contracts, due to the stress applied in the surface direction of the fixing plate 39, in a direction of the stress (in this example, the first direction in FIG. 2), thereby absorbing the stress generated due to the thermal load. As a result, action of the thermal load to the recording head main body 1 can be suppressed, whereby influence of the thermal load against the nozzle plate 20 and the nozzles 21 serving as a printing section can be reduced as much as possible.

Figure 3:
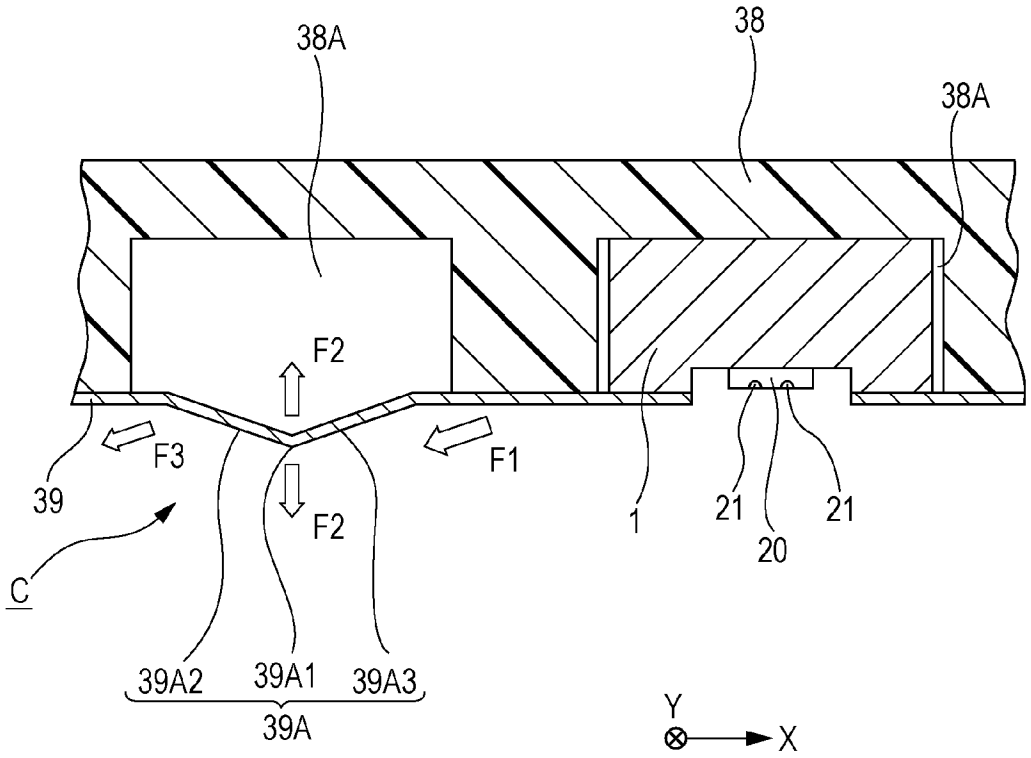
FIG. 3 is an enlarged cross-sectional view in which part of the recording head unit in FIG. 1 is picked out and illustrated.

Further, in the fixing plate 39, expansion/contraction of the fixing plate 39 caused by heat that is transferred from the recording head main body 1 side with the slope section 39A interposed therebetween is absorbed by the movement of the slope section 39A in a direction intersecting with the surface of the fixing plate 39, whereby influence of the stress on the periphery of the nozzles 21 in the nozzle plate 20 can be effectively prevented. This makes it possible to achieve preferable print quality. To be more specific, as shown in FIG. 3 where part in FIG. 1 is picked out and enlarged, a force F1 that is generated due to heat of the recording head main body 1 and applied to the fixing plate 39 in the surface direction thereof is converted to a force F2 at a portion of the slope section 39A where the force F2 displaces the slope portion 39A upward/downward, whereby a force F3 transmitted to a side opposite to the recording head main body 1 with the slope section 39A interposed therebetween is lessened accordingly. This also makes it possible to reduce the thermal load that acts on the fixing plate 39.

Figure 4A:
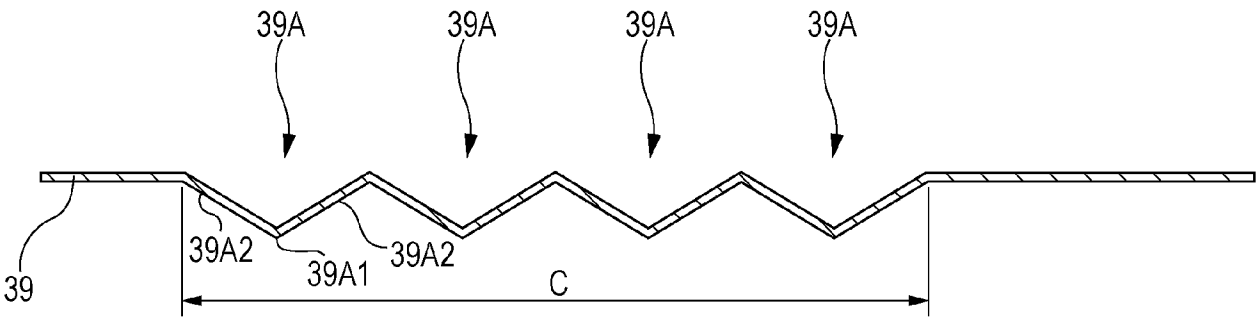
FIGS. 4A and 4B are cross-sectional views schematically illustrating a slope section of a first working example and a slope section of a second working example, which are picked out from those of the working examples, respectively.
Figure 4B:
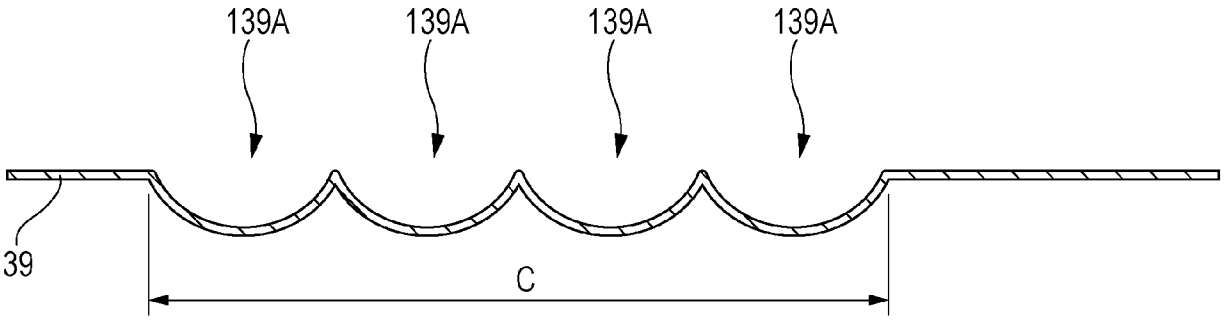

FIGS. 4A and 4B are cross-sectional views schematically illustrating a slope section of a first working example and a slope section of a second working example, which are picked out from those of the working examples, respectively. FIG. 4A shows a case where four of the slope sections 39A are continuously connected to form a bending slope section in bellows form; FIG. 4B shows a case where four curved surfaces 139A each cross section of which is semicircular are continuously connected to form a curved surface in bellows form. As discussed above, in this embodiment, it is sufficient that the slope section includes a portion of which cross section is formed in a mountain-like shape or a curved surface shape and which is arranged in part of the predetermined region C of the fixing plate 39 and capable of freely moving in a direction intersecting with the surface direction of the fixing plate 39. As such, the number of the slope sections is not limited to any specific number as long as at least one slope section configured of a mountain-like shape or curved surface shape portion is present. Further in this embodiment, although the slope sections 39A and 139A are disposed in the predetermined region C so as to expand/contract in the first direction of the fixing plate 39 (see FIG. 2), the invention is not limited thereto. The direction of the expansion/contraction thereof may be the second direction Y. Note that, however, it is more effective to configure the slope section so as to absorb expansion/contraction in the first direction, in which a larger displacement is made due to the thermal expansion of the holder 38 or the like. Furthermore, neither the number of the predetermined regions C nor the location thereof is limited to any specific one. For example, the predetermined regions C may be arranged on both ends of the fixing plate 39 in the first direction or arranged in another mode as needed.

Figure 5A:
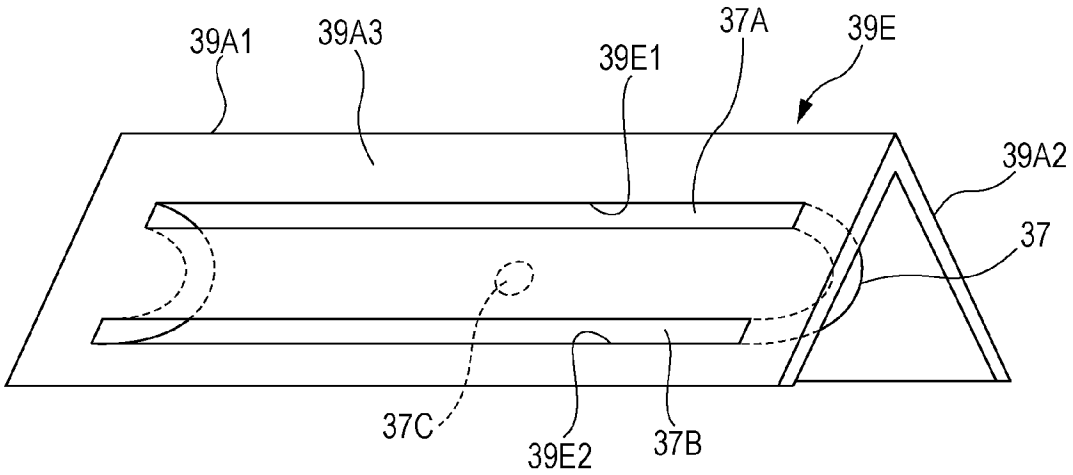
FIGS. 5A through 5C are schematic diagrams illustrating a slope section of a third working example.
Figure 5C:
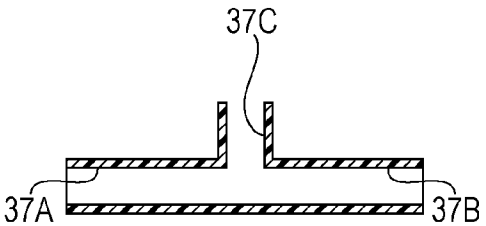
Figure 5B:
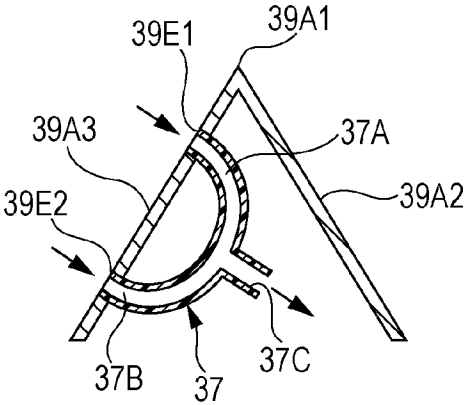

FIGS. 5A through 5C are picked out schematic diagrams illustrating a slope section of a third working example. As shown in FIG. 5A, a slope section 39E of this example basically has the same structure as that of the slope section 39A shown in FIGS. 1 and 2. That is, two planes 39A2 and 39A3 formed by bending a plane along the bending line 39A1 in the predetermined region C of the fixing plate 39 are continued in an integrated manner so as to form a shape of the slope section bent in a mountain-like manner. Further, slits 39E1 and 39E2 extending in the second direction Y are formed at two portions in one plane 39A3 in a width direction thereof (a direction along the slope section). Opening portions 37A and 37B of a suction member 37 face to openings of the slits 39E1 and 39E2, respectively. In other words, as shown in FIG. 5B, the cross section of the suction member 37 is formed in a C shape, and the opening portions 37A and 37B provided on both ends thereof face to the slits 39E1 and 39E2 and fixed to the plane 39A3 from the rear side of the plane. Here, the suction member 37 is, as shown in FIG. 5C, a rectangular hollow member on both the ends of which there are provided the opening portions 37A and 37B; a suction opening 37C is provided in a central portion thereof. The suction member 37 communicates with a suction unit (not shown) that applies a negative pressure, and is configured such that a hollow space of the suction member 37 is sucked by applying a negative pressure to the openings of the slits 39E1 and 39E2.

It is desirable for the suction member 37 to be formed of an elastic member. In the case where the suction member 37 is formed of an elastic member having flexibility, if the suction member 37 is disposed onto the rear surface of the slope section 39A while striding over upper and lower portions in the slant direction thereof so as to face to the openings of the two slits 39E1 and 39E2, respectively, extension of the slope section 39A from the lower portion toward the upper portion due to thermal expansion can be suppressed. Note that the shape or structure of the suction member 37 is not needed to be limited to the one shown in FIGS. 5A through 5C. The suction member 37 may have a tube shape as long as a negative pressure can be applied corresponding to the number and the locations of the slits 39E1 and 39E2 that are provided on the slope section 39A. The number of the slits 39E1 and 39E2 is not needed to be limited to the number of 2.

As for the slits 39E1 and 39E2, the number thereof and their locations in the slope section are not limited to any specific ones. However, in this embodiment, it is optimal for the slits 39E1 and 39E2 to be disposed in the plane 39A3 arranged closest to the recording head main body 1 side within the predetermined region C of the fixing plate 39. The reason for this is as follows: that is, a blade portion 201 for wiping operation comes close to the slope section 39A in the predetermined region C from the right side in FIG. 1 along the first direction X while collecting dirt such as ink lees or the like; note that details of this will be explained later referring to FIG. 7. With the configuration discussed above, dirt can be preferably sucked with the negative pressure applied to the slits 39E1 and 39E2.

Figure 6:
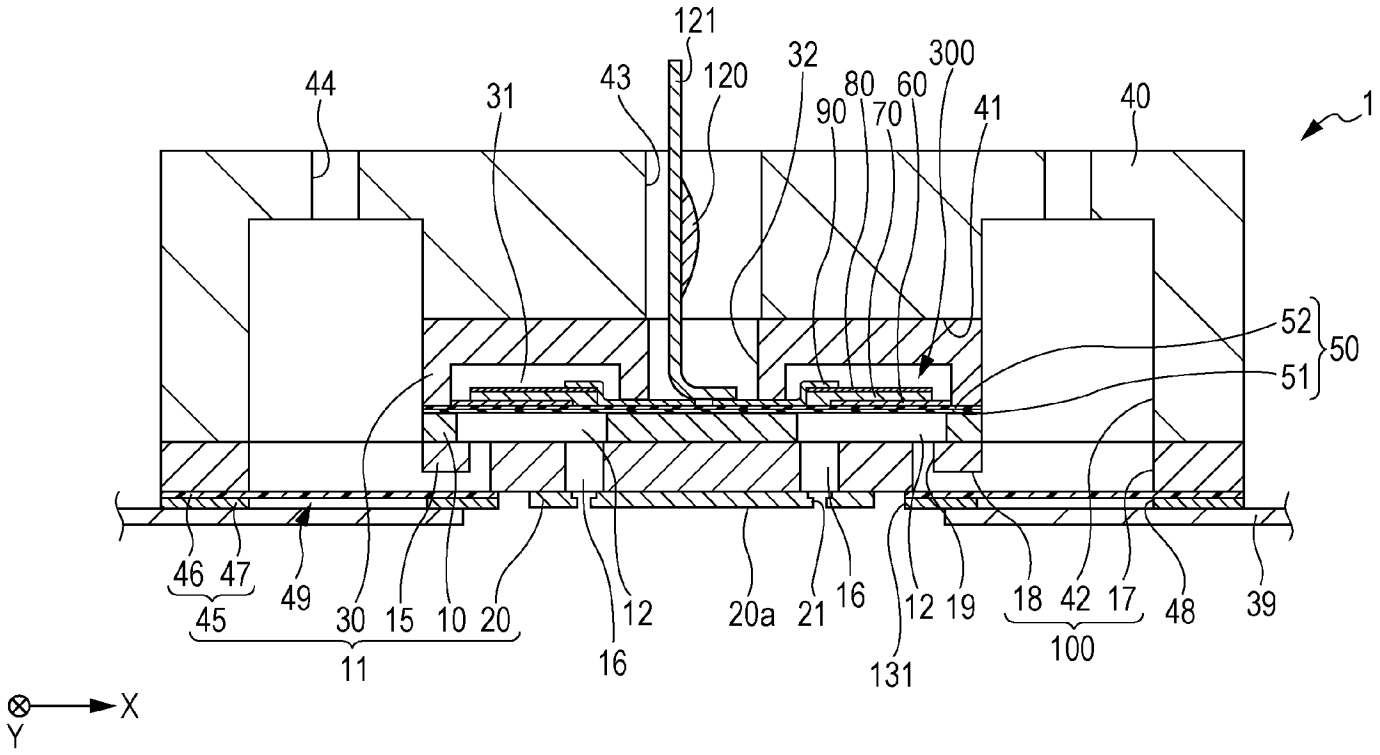
FIG. 6 is a cross-sectional view in which a recording head main body of the recording head unit shown in FIG. 1 is picked out, enlarged, and illustrated as an example.

Here, an example of the recording head main body illustrated in FIGS. 1 and 2 will be described below with reference to FIG. 6. FIG. 6 is a view in which the recording head main body shown in FIG. 1 is picked out and enlarged.

As shown in FIG. 6, the recording head main body 1 in this embodiment includes a plurality of members such as a drive unit 11, a casing member 40, and so on, and these plurality of members are bonded to each other with an adhesive or the like. In this embodiment, the drive unit 11 includes a flow path formation substrate 10, a communication plate 15, the nozzle plate 20, a protection substrate 30, and a compliance substrate 45.

The flow path formation substrate 10 configuring the drive unit 11 can be made of metal such as stainless steel, Ni, or the like, a ceramic material represented by $ZrO_2$ or $Al_2O_3$, a glass ceramic material, oxide such as MgO or $LaAlO_3$, or the like. In this embodiment, the flow path formation substrate 10 is made of a silicon single crystal substrate. In the flow path formation substrate 10, pressure generation chambers 12 defined by a plurality of separation walls through carrying out anisotropic etching from one surface side are provided in parallel with one another along the second direction Y in which the plurality of nozzles 21 for discharging ink are arranged in parallel to one another. Note that in the flow path formation substrate 10, there are provided a plurality of rows in each of which the pressure generation chambers 12 are provided in parallel with one another along the second direction Y. In the embodiment, two rows are provided.

The communication plate 15 is bonded to the one surface side of the flow path formation substrate 10. To the communication plate 15, bonded is the nozzle plate 20 where the plurality of nozzles 21 communicating with the pressure generation chambers 12 are arranged penetrating therethrough.

A nozzle communication path 16 that makes the pressure generation chamber 12 communicate with the nozzle is provided in the communication plate 15. The communication plate 15 has a larger area than the flow path formation substrate 10, while the nozzle plate 20 has a smaller area than the flow path formation substrate 10. By making the area of the nozzle plate 20 relatively small in the manner described above, reduction in costs can be achieved. Note that in this embodiment, a surface through which an ink droplet is discharged with the nozzle 21 in the nozzle plate 20 being opened is referred to as a liquid ejecting surface 20*a*.

In the communication plate 15, there are further provided a first manifold portion 17 and a second manifold portion 18 configuring part of a manifold 100.

The first manifold portion 17 is provided penetrating through the communication plate 15 in a thickness direction thereof (laminating direction of the communication plate 15 and the flow path formation substrate 10).

Meanwhile, the second manifold portion 18 is provided being opened on the nozzle plate 20 side of the communication plate 15 without penetrating the communication plate 15 in the thickness direction.

Furthermore in the communication plate 15, a supply communication path 19 communicating with one end portion of the pressure generation chamber 12 in the first direction X is provided independently for each pressure generation chamber 12. The supply communication path 19 makes the second manifold portion 18 communicate with the pressure generation chamber 12.

As the communication plate 15 discussed above, metal such as stainless steel or Ni, ceramics such as zirconium, or the like can be used. It is preferable for the communication plate 15 to be formed of a material whose linear expansion coefficient is equal to that of the flow path formation substrate 10. In other words, in the case where a material whose linear expansion coefficient is largely different from that of the flow path formation substrate 10 as the communication plate 15, a warp will be generated, when heated or cooled, due to the difference in linear expansion coefficients between the flow path formation substrate 10 and the communication plate 15. In this embodiment, the communication plate 15 and the flow path formation substrate 10 are formed of the same material, which is a silicon single crystal substrate, thereby making it possible to suppress generation of a warp due to heat, and generation of a crack, separation, or the like due to heat.

The nozzles 21 each of which communicates with the pressure generation chamber 12 through the nozzle communication path 16 are arranged in the nozzle plate 20. In other words, the nozzles 21 that eject the same kind of liquid (ink) are arranged in parallel with each other in a row along the first direction X, and two rows are formed in the first direction X, in each of which the above-discussed nozzles 21 are arranged in parallel with each other along the first direction X.

As the nozzle plate 20 discussed above, metal such as stainless steel (SUS) or the like, an organic material such as a polyimide resin, or a silicon single crystal substrate or the like can be used, for example. By using a silicon single crystal substrate as the nozzle plate 20 and making the linear expansion coefficients of the nozzle plate 20 and the communication plate 15 the same, it is possible to suppress the generation of a warp due to being heated or cooled, a crack or separation due to heat, and the like.

Because the cost reduction of the nozzle plate 20 can be achieved when it is formed in an area as small as possible as described before, the liquid ejecting surface 20*a* in this embodiment has a rectangular shape whose longer side is provided along the second direction Y as a direction along which the nozzles 21 are arranged in parallel with one another.

Meanwhile, on a surface of the flow path formation substrate 10 on the side opposite to the communication plate 15, a vibration plate 50 is formed. In this embodiment, as the vibration plate 50, there are provided an elastic film made of silicon oxide and arranged on the flow path formation substrate 10 side and an insulation film 52 made of zirconium oxide and arranged on the elastic film 51. Note that a liquid flow path such as the pressure generation chamber 12 or the like is formed by carrying out anisotropic etching on the flow path formation substrate 10 from the one surface side thereof (surface side on which the nozzle plate 20 is bonded), and the other surface of the liquid flow path such as the pressure generation chamber 12 or the like is defined by the elastic film 51.

On the insulation film 52 of the vibration plate 50, a first electrode 60, a piezoelectric layer 70, and a second electrode 80 are formed being laminated using, in this embodiment, deposition and lithography methods so as to configure a piezoelectric actuator 300. Further, the protection substrate 30 having substantially the same size as the flow path formation substrate 10 is bonded to a surface of the flow path formation substrate 10 on the piezoelectric actuator 300 side. The protection substrate 30 includes a retaining portion 31 as a space for protecting the piezoelectric actuator 300. Further, the protection substrate 30 is provided with a through-hole 32 penetrating therethrough in the thickness direction (laminating direction of the flow path formation substrate 10 and the protection substrate 30). One end portion of a leading electrode 90 on a side opposite to the other end portion thereof connected to the second electrode 80 is so extended as to be exposed in the through-hole 32; in the through-hole 32, the leading electrode 90 and a wiring substrate 121 mounting a drive circuit 120 such as a drive IC and the like are electrically connected.

To the drive unit 11 configured in the manner described above, the casing member 40 that defines, along with the drive unit 11, the manifold 100 communicating with a plurality of the pressure generation chambers 12 is fixed. The casing member 40 has substantially the same shape as the above-mentioned communication plate 15 when viewed from above, and is bonded to the protection substrate 30 as well as to the communication plate 15. More specifically, the casing member 40 includes, on the protection substrate 30 side, a recess 41 having such a depth that the flow path formation substrate 10 and the protection substrate 30 are accommodated therein. Further, in the periphery of the flow path formation substrate 10 and the protection substrate 30, a third manifold portion 42 is defined in the casing member 40. As such, the manifold 100 of this embodiment is configured by the first manifold portion 17 and the second manifold portion 18 that are provided in the communication plate 15 and the third manifold portion 42.

As a material of the casing member 40, resin, metal, or the like can be used, for example. Mass production at low cost can be realized by forming a resin material as the casing member 40.

The compliance substrate 45 is provided on a surface where the first manifold portion 17 and second manifold portion 18 in the communication plate 15 are opened. The compliance substrate 45 seals the openings of the first manifold portion 17 and second manifold portion 18 on the liquid ejecting surface 20*a* side.

The compliance substrate 45 of this embodiment is equipped with a sealing film 46 and a fixing substrate 47. The sealing film 46 is formed of a flexible thin film (for example, a thin film formed of polyphenylene sulfide (PPS), stainless steel (SUS), or the like and having a thickness of 20 μm or less), and the fixing substrate 47 is formed of a hard material such as metal like stainless steel (SUS) or the like. Because a region opposing the manifold 100 in the fixing plate 47 is configured of only an opening portion 48 which is a portion having been completely removed in the thickness direction, one surface of the manifold 100 is a compliance portion 49, which is a flexible portion sealed only by the flexible sealing film 46.

An introduction path 44 that communicates with the manifold 100 so as to supply ink to each of the manifolds 100 is provided in the casing member 40. Further, in the casing member 40, there is provided a connection port 43 which is in communication with the through-hole 32 in the protection substrate 30 and into which the wiring substrate 121 is inserted.

In the recording head main body 1 configured as described above, when ink is to be ejected, ink is introduced from an ink cartridge 2 through the introduction path 44 to fill the inside of the flow path from the manifold 100 down to the nozzles 21 with the ink. Thereafter, a voltage is applied to each of the piezoelectric actuators 300 corresponding to the respective pressure generation chambers 12 in accordance with a signal from the drive circuit 120 so as to cause the piezoelectric actuator 300 and the vibration plate 50 to bend and deform. With this, pressure within the pressure generation chamber is raised and ink is ejected through a predetermined nozzle 21. In the ink jet recording head II of this embodiment, a path from the connection port 43 down to the nozzles 21 is referred to as a liquid flow path. In other words, the liquid flow path is configured of the connection port 43, the manifold 100, the supply communication path 19, the pressure generation chamber 12, the nozzle communication path 16, and the nozzle 21.

The fixing plate 39 is provided on the liquid ejecting surface 20*a* side of the drive unit 11 as a cover head, which is a protection member in this embodiment. The fixing plate 39 is bonded to a surface of the compliance substrate 45 on the opposite side to the communication plate 15, and seals a space on the opposite side to the flow path (manifold 100) of the compliance portion 49. An exposure opening portion 131 as an opening portion for exposing the liquid ejecting surface including the nozzle 21 is provided in the fixing plate 39. In this embodiment, the opening of the exposure opening portion 131 has a size capable of exposing the nozzle plate 20, that is, the same size as the opening of the compliance substrate 45.

The above-discussed fixing plate 39 in this embodiment is provided projecting toward a recording sheet S side in comparison with the liquid ejecting surface 20*a* of the nozzle plate 20 in an ink (liquid) discharge direction. By projecting the fixing plate 39 toward the recording sheet S side further than the liquid ejecting surface 20*a* as described above, the recording sheet S becomes unlikely to make contact with the nozzle plate 20, whereby the occurrence of deformation, separation, and so on of the nozzle plate 20 due to the recording sheet S making contact with the nozzle plate 20 can be suppressed.

Figure 7:
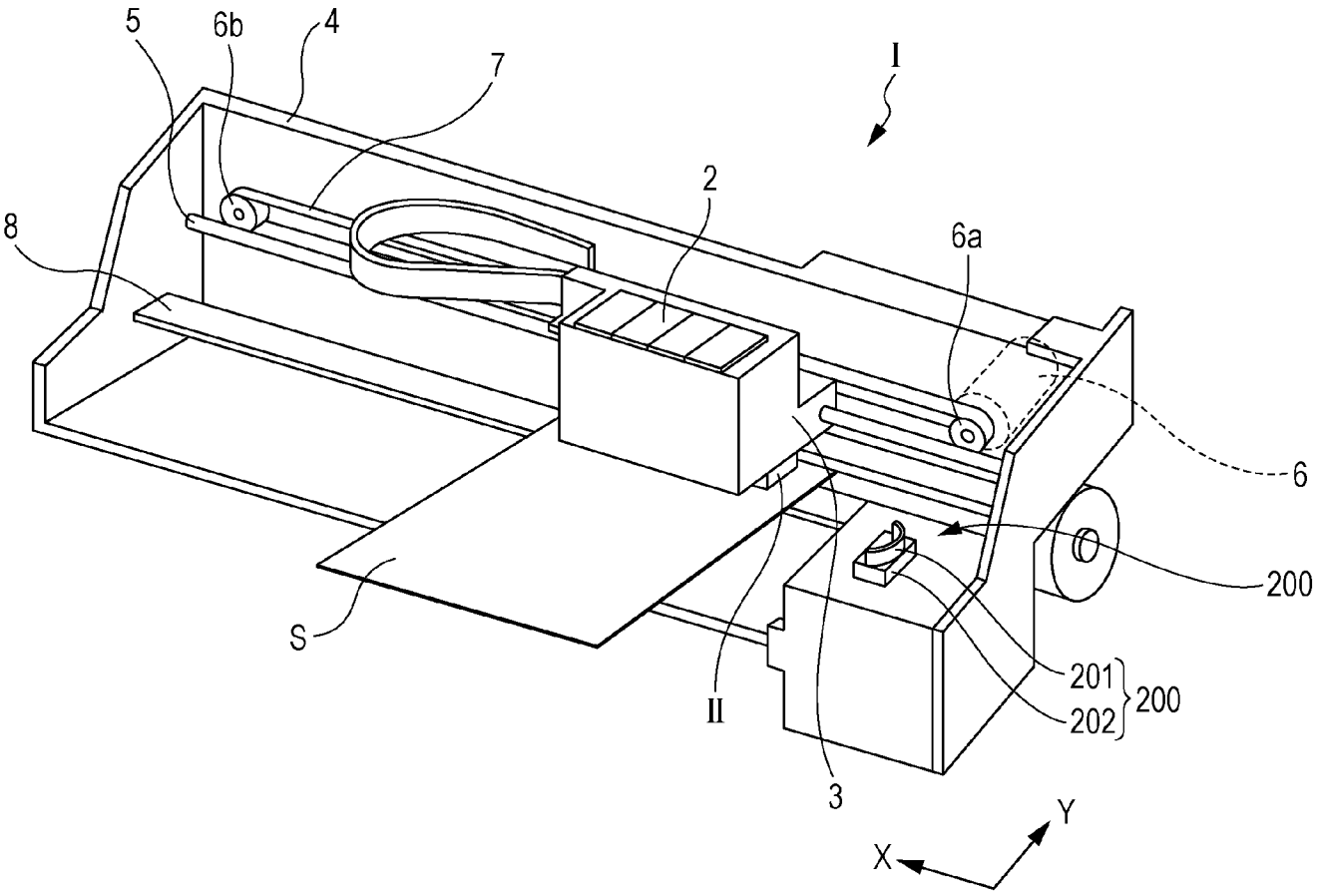
FIG. 7 is a schematic perspective view of an ink jet recording apparatus according to an embodiment of the invention.

FIG. 7 illustrates a recording apparatus I mounting the recording head unit II in which a plurality of the recording head main bodies 1 are integrated. As shown in FIG. 7, the recording apparatus I is configured such that the first direction X is defined to be a main scanning direction, which is a direction in which a carriage 3 moves together with the recording head unit II in an integrated manner. The recording apparatus I is provided with a wiping unit 200 to be explained later in detail. The wiping unit 200 wipes the liquid ejecting surface 20*a* of each of the recording head main bodies 1 configuring the recording head unit II by the movement of the recording head unit II along the first direction X. In other words, the first direction X is also a wiping direction of the wiping unit 200.

In this embodiment, the wiping unit 200 of the recording apparatus I includes the blade portion 201 made of a plate member that is formed of an elastic material such as rubber, elastomer, or the like and a base portion 202 to which the blade portion 201 is anchored. The base portion 202 is disposed in a region at the outside of a region where ink is landed on the recording sheet S, that is, disposed at a position within a non-printing region opposing the liquid ejecting surface 20*a*. The base portion 202 may be so provided as to be capable of moving in the ink discharge direction. A base end of the blade portion 201 is anchored to the base portion 202 so that a leading end thereof becomes a free end. Further, the blade portion 201 is disposed in a manner in which the leading end thereof as a free end projects toward the liquid ejection surface 20*a* so that a surface direction thereof takes the second direction Y. Furthermore, in this embodiment, in order for one surface of the blade portion 201 to have a concave shape, the blade portion 201 is disposed being bent with respect to a straight line in the second direction Y.

The blade portion 201 is disposed so that a length thereof in the second direction Y is longer than a length of a row of the nozzles 21 provided in the nozzle plate 20 in the second direction Y. Further in this embodiment, the length of the blade portion 201 in the second direction Y is set to be longer than a length of the fixing plate 39 in the second direction Y. This makes it possible for the blade portion 201 to wipe the entirety of the surface of the fixing plate 39 and the liquid ejecting surface 20*a*. In other words, the wiping unit 200 wipes the liquid ejecting surface 20*a* in the manner in which the blade portion 201 moves in the first direction X relative to the recording head main bodies 1 configuring the recording head II so that the leading end of the blade portion 201 wipes the liquid ejecting surface 20*a*.

Here, the relative movement between the blade portion 201 (wiping unit 200) and the recording head unit II is carried out by moving the carriage 3 in the main scanning direction (first direction X). Needless to say, the relative movement between the wiping unit 200 and the ink jet recording head II is not limited to the movement of the carriage 3; the relative movement may be carried out by providing a movement device or the like configured to move the wiping unit 200 in the main scanning direction (first direction X) and moving the wiping unit 200 in a state where the carriage 3 mounting the recording head II is stopped. Moreover, the wiping unit 200 may move in a sub-scanning direction relative to the ink jet recording head II and the blade portion 201 may wipe the liquid ejecting surface 20*a* in the second direction Y.

The blade portion 201 of the wiping unit 200, after having wiped the surface of the fixing plate 39, wipes the liquid ejecting surface 20*a* of the nozzle plate 20. In other words, moving the recording head unit II in the first direction X relative to the wiping unit 200 causes the leading end of the blade portion 201 to wipe the surface of the fixing plate 39 (on the liquid ejecting surface 20*a* side). This makes it possible to wipe ink (liquid), fluff, dust, paper powder, and the like adhering to the surface of the fixing plate 39. Then, in the case where the recording head unit II is further moved in the first direction X relative to the wiping unit 200, the leading end of the blade portion 201 leaves an end portion of the fixing plate on the nozzle plate side and lands on a predetermined region in the liquid ejecting surface 20*a* between the nozzle 21 of the nozzle plate 20 and an end portion of the nozzle plate 20 on the opposite side to the wiping direction (first direction X in this embodiment).

Then, along with the movement of the carriage 3 in the first direction X, the nozzle plates 20 of the recording head main bodies 1 are sequentially wiped and then the blade portion 201 makes contact with a rear surface of the fixing plate 39. In this state, along with the movement of the carriage 3, the rear surface of the fixing plate 39 is wiped, and the blade portion 201 finally makes contact with the slope portion 39A (see FIG. 1 and FIGS. 5A through 5C; the same applied hereinafter) in the predetermined region C (see FIG. 1; the same applied hereinafter). While the blade portion 201 being in contact with the slope section 39A, by applying a negative pressure to the slits 39E1 and 39E2 in the slope portion 39A, dirt such as ink lees or the like gathered by the blade portion 201 is collected in the suction member 37 and discarded. Accordingly, in this embodiment, the slope section 39A having the slits 39E1 and 39E2 is disposed at the position closest to the recording head main body 1.

As such, in the recording apparatus according to the embodiment, not only the wiping of the liquid ejecting surface 20*a* but also the disposal of the dirt gathered through the wiping can be preferably carried out.

The embodiments of the invention have been described thus far; note that, however, the invention is intended to be applied to a wide range of general liquid ejecting head main bodies, and can certainly be applied to liquid ejecting head main bodies that eject liquids other than ink. As different types of liquid ejecting head main bodies, various kinds of recording heads used in image recording apparatuses such as printers or the like, coloring-material ejecting heads used in the manufacture of color filters for liquid crystal displays or the like, electrode-material ejecting heads used in the formation of electrodes for organic EL displays, FEDs (field emission displays), or the like, bioorganic-substance ejecting heads used in the manufacture of biochips, and so on can be cited.

The entire disclosure of Japanese Patent Application No. 2014-189732, filed Sep. 18, 2014 is expressly incorporated by reference herein.

What is claimed is:

1. A liquid ejecting head comprising:

a liquid ejecting head main body that drives a drive element to generate a pressure change in a liquid filling a pressure generation chamber so as to eject the liquid through a nozzle formed in a nozzle plate;

a holder to hold the liquid ejecting head main body; and a fixing plate to which end surfaces, on the nozzle plate side, of the liquid ejecting head main body and the holder are fixed, wherein the fixing plate includes a slope section that is arranged in part of a predetermined region of the fixing plate where neither the holder nor the liquid ejecting head main body is fixed, and that has a free movement portion of which cross section is formed in a mountain-like shape or a curved surface shape and which is capable of freely moving in a direction intersecting with a surface direction of the fixing plate, the fixing plate further includes a fixing portion with which a base end of the free movement portion is fixed to the holder, and the fixing plate is so configured as to be expanded/contracted in the surface direction of the fixing plate by a force applied in this direction.

2. The liquid ejecting head according to claim 1, wherein the slope section is recessed from a surface of the fixing plate toward the holder side or projected toward a side opposite to the holder.

3. A liquid ejecting apparatus including the liquid head according to claim 2.

4. The liquid ejecting head according to claim 1, wherein the slope section is a section where a plurality of surfaces are continuously provided in bellows form with the fixing portion being interposed in the surface direction of the fixing plate.

5. A liquid ejecting apparatus including the liquid head according to claim 4.

6. The liquid ejecting head according to claim 1, wherein the slope section is configured such that an opened slit is provided in part of the slope section, an opening portion of a suction member faces to an opening of the slit, and a negative pressure is applied to the opening of the slit so as to suck a hollow space of the suction member.

7. The liquid ejecting head according to claim 6, wherein the slit is opened to the liquid ejecting head main body side in the slope section arranged to be closest to the liquid ejecting head main body side within the predetermined region of the fixing plate.

8. A liquid ejecting apparatus including the liquid head according to claim 7.

9. The liquid ejecting head according to claim 6, wherein the suction member is made of an elastic member and has two above-mentioned opening portions, and the opening portions are arranged in a rear surface of the slope section while striding over upper and lower portions in a slant direction of the slope section so as to face to the openings of two slits, respectively.

10. A liquid ejecting apparatus including the liquid head according to claim 9.

11. A liquid ejecting apparatus including the liquid head according to claim 6.

12. A liquid ejecting apparatus including the liquid head according to claim 1.

* * * * *